US010608362B2

(12) United States Patent
Mori et al.

(10) Patent No.: US 10,608,362 B2
(45) Date of Patent: Mar. 31, 2020

(54) RELAY TERMINAL AND RELAY CONNECTOR

(71) Applicant: Yazaki Corporation, Tokyo (JP)

(72) Inventors: Shigeo Mori, Shizuoka (JP); Fuminori Sugiyama, Shizuoka (JP); Hiroyuki Tanaka, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/364,100

(22) Filed: Mar. 25, 2019

(65) Prior Publication Data

US 2019/0305459 A1 Oct. 3, 2019

(30) Foreign Application Priority Data

Apr. 3, 2018 (JP) ..... 2018-071628

(51) Int. Cl.

| | |
|---|---|
| ***H01R 13/24*** | (2006.01) |
| ***H01R 13/502*** | (2006.01) |
| ***H01R 43/24*** | (2006.01) |
| ***H01R 13/11*** | (2006.01) |
| ***H01R 13/187*** | (2006.01) |
| ***H01R 13/631*** | (2006.01) |

(Continued)

(52) U.S. Cl.

CPC ..... *H01R 13/2464* (2013.01); *H01R 13/113* (2013.01); *H01R 13/187* (2013.01); *H01R 13/502* (2013.01); *H01R 13/6315* (2013.01); *H01R 43/24* (2013.01); *H01H 45/14* (2013.01); *H01R 13/2492* (2013.01); *H01R 25/006* (2013.01); *H01R 2201/26* (2013.01)

(58) Field of Classification Search

CPC .... H01R 31/08; H01R 31/085; H01R 31/005; H01R 31/06

USPC ..... 439/512, 510, 787

See application file for complete search history.

(56) References Cited

U.S. PATENT DOCUMENTS 2,904,771 A * 9/1959 Burtt ..... H01R 31/00 439/654

4,029,377 A * 6/1977 Guglielmi ..... H01R 31/085 439/510

(Continued)

FOREIGN PATENT DOCUMENTS

| | | |
|---|---|---|
| JP | 2009-99429 A1 | 5/2009 |
| WO | 2012/058807 A1 | 5/2012 |

*Primary Examiner* — Neil Abrams

(74) *Attorney, Agent, or Firm* — Kenealy Vaidya LLP

(57) ABSTRACT

A first terminal housing chamber of a terminal body includes a first elastic contact part that contacts the first counterpart terminal while imparting resilient force in a direction orthogonal to an insertion direction of the first counterpart terminal, and gaps with respect to the first counterpart terminal in a direction orthogonal to the insertion direction of the first counterpart terminal and the resilient force imparting direction of the first elastic contact part. A second terminal housing chamber of the terminal body includes a second elastic contact part that contacts the second counterpart terminal while imparting resilient force in a direction orthogonal to an insertion direction of the second counterpart terminal, and gaps with respect to the second counterpart terminal in a direction orthogonal to the insertion direction of the second counterpart terminal and the resilient force imparting direction of the second elastic contact part.

11 Claims, 16 Drawing Sheets

(51) Int. Cl.
*H01H 45/14* (2006.01)
*H01R 25/00* (2006.01)

(56) References Cited

U.S. PATENT DOCUMENTS 4,392,702 A * 7/1983 Walkup ..... H01R 31/08 439/507
4,482,198 A * 11/1984 Crowley ..... H01R 31/08 439/510
4,514,784 A * 4/1985 Williams ..... H01R 12/52 361/716
4,813,881 A * 3/1989 Kirby ..... H01R 13/111 439/381
4,966,563 A * 10/1990 Pierce ..... H01R 25/142 439/729
5,383,800 A * 1/1995 Saka ..... B60R 16/02 439/76.2
5,603,626 A * 2/1997 Oka ..... H01H 85/2035 439/224
6,036,534 A * 3/2000 Hoyt ..... H01R 31/08 439/483
6,773,285 B2 * 8/2004 Bernat ..... H01R 13/6315 439/246
6,932,625 B2 * 8/2005 Yagi ..... H01R 31/08 439/76.2
8,038,488 B2 * 10/2011 Mukuno ..... H01R 13/187 439/845
8,740,642 B2 * 6/2014 Keenihan ..... H01R 31/00 439/510
9,954,298 B2 * 4/2018 Torcheux ..... H01R 13/113
10,050,400 B2 * 8/2018 Eckel ..... H01R 13/22
10,218,105 B2 * 2/2019 Stange ..... H01R 13/113
2019/0305459 A1 * 10/2019 Mori ..... H01R 43/24

* cited by examiner

RELAY TERMINAL AND RELAY CONNECTOR

CROSS-REFERENCE TO RELATED APPLICATION(S)

The present application claims priority to and incorporates by reference the entire contents of Japanese Patent Application No. 2018-071628 filed in Japan on Apr. 3, 2018.

BACKGROUND OF THE INVENTION

1. Field of the Invention

The present invention relates to a relay terminal and a relay connector.

2. Description of the Related Art

Conventionally, a relay terminal and a relay connector that electrically connect two objects to be electrically connected have been known. For example, Japanese Patent Application Laid-open No. 2009-99429 discloses a technique of interposing a conductive spring between a mating connector of one of the objects to be electrically connected and a mating connector of the other object to be electrically connected, and using that conductive spring as a relay terminal between the two. In the technique of Japanese Patent Application Laid-open No. 2009-99429, the two objects to be electrically connected are electrically connected by connecting counterpart terminals of the respective mating connectors with the conductive spring. In addition, in the technique of Japanese Patent Application Laid-open No. 2009-99429, an insertion/extraction direction of the two mating connectors conforms to an expansion/contraction direction of the conductive spring, and tolerance and variation in a fitting direction of the two connectors is absorbed by the expansion/contraction of that conductive spring.

Meanwhile, a relay terminal has multi-directional tolerance and variation between each of counterpart terminals to be connected by itself. Thus, the relay terminal is desired to be such a relay terminal that can absorb the multi-directional tolerance and variation in order to improve an electrical connection state of the respective counterpart terminals.

SUMMARY OF THE INVENTION

Therefore, an objective of the present invention is to provide a relay terminal and a relay connector that are capable of absorbing multi-directional tolerance and variation between counterpart terminals.

In order to achieve the above mentioned object, a relay terminal according to one aspect of the present invention includes a terminal body including a first terminal housing chamber into which a first counterpart terminal is inserted and housed, and a second terminal housing chamber into which a second counterpart terminal is inserted and housed, wherein the first terminal housing chamber serves either of two openings that are opposingly arranged as an insertion opening for the first counterpart terminal, and includes a first elastic contact part that contacts the first counterpart terminal housed in the first terminal housing chamber while imparting resilient force in a direction orthogonal to an insertion direction of the first counterpart terminal, and a gap with respect to the first counterpart terminal housed in the first terminal housing chamber in a direction orthogonal to the insertion direction of the first counterpart terminal and the resilient force imparting direction of the first elastic contact part, and the second terminal housing chamber serves either of two openings that are opposingly arranged as an insertion opening for the second counterpart terminal, and includes a second elastic contact part that contacts the second counterpart terminal housed in the second terminal housing chamber while imparting resilient force in a direction orthogonal to an insertion direction of the second counterpart terminal, and a gap with respect to the second counterpart terminal housed in the second terminal housing chamber in a direction orthogonal to the insertion direction of the second counterpart terminal and the resilient force imparting direction of the second elastic contact part.

According to another aspect of the present invention, in the relay terminal, it is possible to configure that the first terminal housing chamber and the second terminal housing chamber are formed such that the insertion direction of the first counterpart terminal and the insertion direction of the second counterpart terminal are the same or are opposite from each other.

According to still another aspect of the present invention, in the relay terminal, it is possible to configure that the terminal body includes first to third electrical connection bodies that are arranged in parallel with intervals from one another, and a coupling body that integrates the first to the third electrical connection bodies, the first terminal housing chamber is formed by utilizing a space between the first electrical connection body and the second electrical connection body that are opposingly arranged with an interval from each other, and the second terminal housing chamber is formed by utilizing a space between the second electrical connection body and the third electrical connection body that are opposingly arranged with an interval from each other.

According to still another aspect of the present invention, in the relay terminal, it is possible to configure that the first elastic contact part is formed in at least either of the first electrical connection body and the second electrical connection body, and the second elastic contact part is formed in at least either of the second electrical connection body and the third electrical connection body.

According to still another aspect of the present invention, in the relay terminal, it is possible to further include that a first contact member assembled in the first terminal housing chamber, and a second contact member assembled in the second terminal housing chamber, wherein the first contact member has the first elastic contact part, and the second contact member has the second elastic contact part.

In order to achieve the above mentioned object, a relay connector according to still another aspect of the present invention includes a relay terminal; and a housing including a terminal holding chamber in which the relay terminal is housed and held, wherein the relay terminal includes a terminal body including a first terminal housing chamber into which a first counterpart terminal is inserted and housed, and a second terminal housing chamber into which a second counterpart terminal is inserted and housed, the first terminal housing chamber serves either of two openings that are opposingly arranged as an insertion opening for the first counterpart terminal, and includes a first elastic contact part that contacts the first counterpart terminal housed in the first terminal housing chamber while imparting resilient force to a direction orthogonal to an insertion direction of the first counterpart terminal, and a gap with respect to the first counterpart terminal housed in the first terminal housing chamber in a direction orthogonal to the insertion direction of the first counterpart terminal and the resilient force imparting direction of the first elastic contact part, the second terminal housing chamber serves either of two openings that are opposingly arranged as an insertion opening for the second counterpart terminal, and includes a second elastic contact part that contacts the second counterpart terminal housed in the second terminal housing chamber while imparting resilient force in a direction orthogonal to an insertion direction of the second counterpart terminal, and a gap with respect to the second counterpart terminal housed in the second terminal housing chamber in a direction orthogonal to the insertion direction of the second counterpart terminal and the resilient force imparting direction of the second elastic contact part, the first terminal housing chamber and the second terminal housing chamber are formed such that the insertion direction of the first counterpart terminal and the insertion direction of the second counterpart terminal are the same or are different from each other, and the terminal holding chamber has an insertion opening for the first counterpart terminal that is arranged so as to oppose the insertion opening for the first counterpart terminal in the first terminal housing chamber, an insertion opening for the second counterpart terminal that is arranged so as to oppose the insertion opening for the second counterpart terminal in the second terminal housing chamber, a first gap that is configured to relatively move the relay terminal housed in the terminal holding chamber in the resilient force imparting direction of the first elastic contact part, and a second gap that is configured to relatively move the relay terminal housed in the terminal holding chamber in a direction orthogonal to the insertion direction of the first counterpart terminal and the resilient force imparting direction of the first elastic contact part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
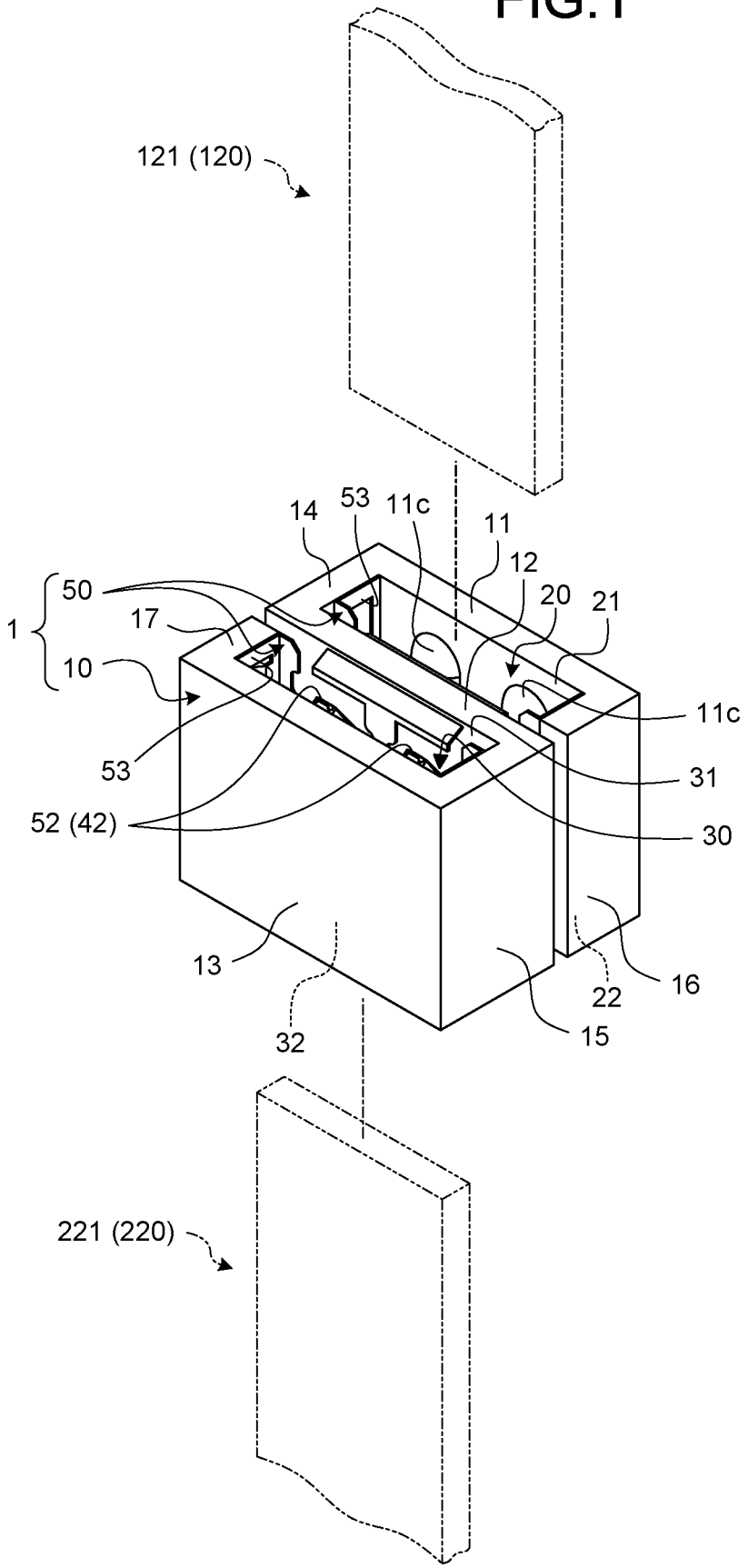
FIG. 1 is a perspective view of a relay terminal in an embodiment that is seen from one side of an opening.

Hereinafter, an embodiment of a relay terminal and a relay connector according to the present invention is described in detail with reference to the drawings. The present invention is not limited to this embodiment.

Embodiment

An embodiment of the relay terminal and the relay connector according to the present invention is described based on FIG. 1 to FIG. 16.

Reference sign 1 in FIG. 1 to FIG. 7 denotes the relay terminal of the present embodiment.

The relay terminal 1 is a terminal that connects a first counterpart terminal 120 and a second counterpart terminal 220, and that allows a physical and electrical connection therebetween. The relay terminal 1 includes at least a conductive terminal body 10 that is made of a conductive material such as metal (FIG. 1 to FIG. 7). The terminal body 10 has a first terminal housing chamber 20 into which the first counterpart terminal 120 is inserted and housed, and a second terminal housing chamber 30 into which the second counterpart terminal 220 is inserted and housed (FIG. 1 to FIG. 7).

The first terminal housing chamber 20 is formed in a shape that conforms to the shape of an electrical connection part 121 of the first counterpart terminal 120 such that the electrical connection part 121 can be inserted or extracted. The electrical connection part 121 of the first counterpart terminal 120 is formed in a rectangular plate shape (i.e., a male tab shape), as will be described later. Thus, the first terminal housing chamber 20 is formed in a cuboid shape. In the first terminal housing chamber 20, the electrical connection with the first counterpart terminal 120 is achieved by inserting and housing the electrical connection part 121 along the insertion direction. In addition, in the first terminal housing chamber 20, the electrical connection with the first counterpart terminal 120 is released by extracting the housed electrical connection part 121 along the extraction direction. The insertion/extraction direction of the electrical connection part 121 of the first counterpart terminal 120 with respect to the first terminal housing chamber 20 will be collectively referred to as the "insertion/extraction direction" herein.

Figure 2:
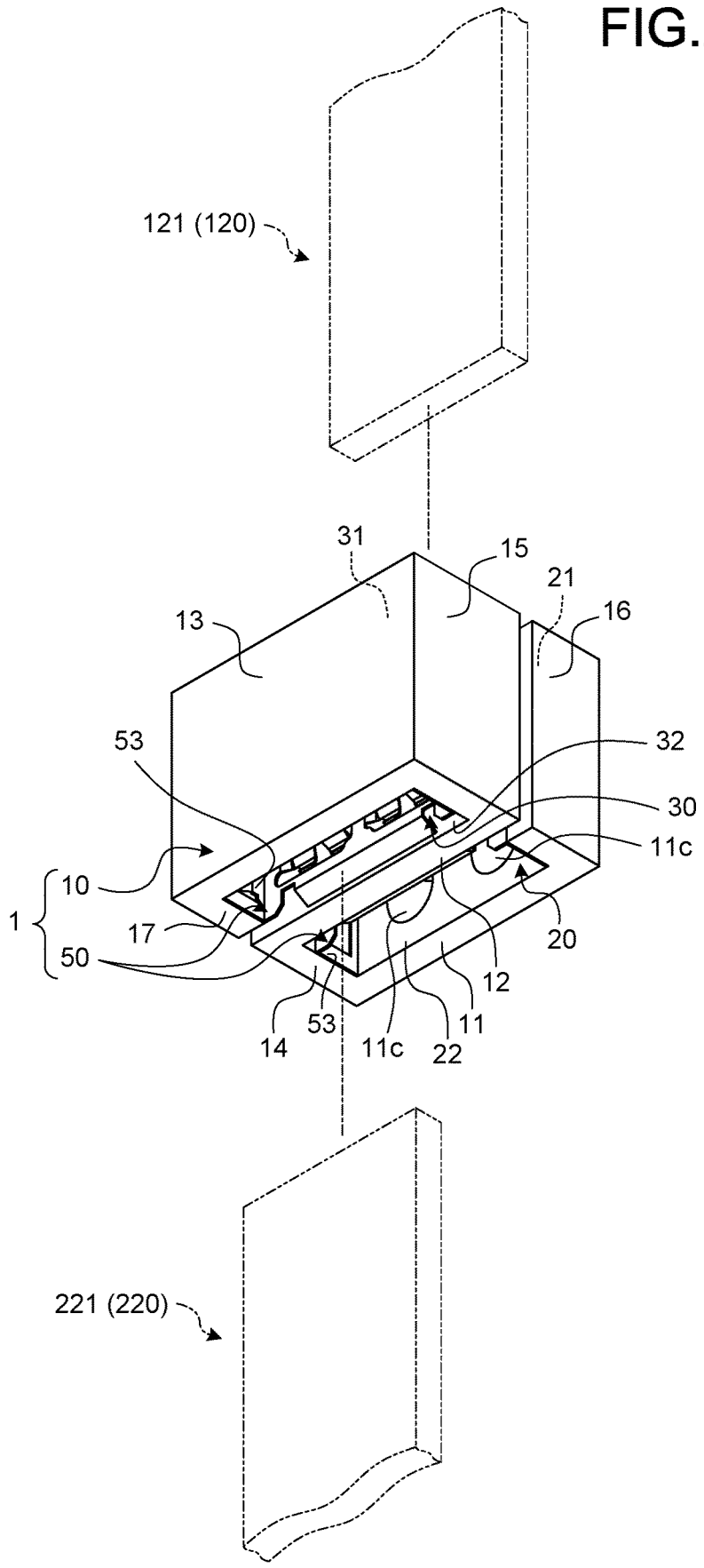
FIG. 2 is a perspective view of the relay terminal in the embodiment that is seen from the other side of the opening.

The first terminal housing chamber 20 has two openings 21, 22 that are opposingly arranged (FIG. 1 and FIG. 2). Furthermore, the first terminal housing chamber 20 serves either of the two openings 21, 22 as an insertion opening for the electrical connection part 121 of the first counterpart terminal 120. Thus, the first terminal housing chamber 20 can cause the electrical connection part 121 that is inserted from either of the two openings 21, 22 to project from the other opening. In other words, the electrical connection part 121 can be inserted through the first terminal housing chamber 20 through the two openings 21, 22. In this manner, the relay terminal 1 can change a relative position of the first counterpart terminal 120 with respect to the first terminal housing chamber 20 in the insertion/extraction direction (i.e., a housed position of the electrical connection part 121), while ensuring the electrical connection state between the first terminal housing chamber 20 and the first counterpart terminal 120. For example, by setting an interval of the two openings 21, 22 of the first terminal housing chamber 20 shorter than the length of the electrical connection part 121 in the insertion/extraction direction, the relay terminal 1 can ensure the electrical connection state between the first terminal housing chamber 20 and the first counterpart terminal 120 even when the housed position of the electrical connection part 121 in the insertion/extraction direction has changed. Accordingly, the relay terminal 1 can absorb tolerance and variation between the first terminal housing chamber 20 and the first counterpart terminal 120 in the insertion/extraction direction.

The exemplified first terminal housing chamber 20 serves the opening 21 as the insertion opening for the electrical connection part 121 of the first counterpart terminal 120.

Figure 3:
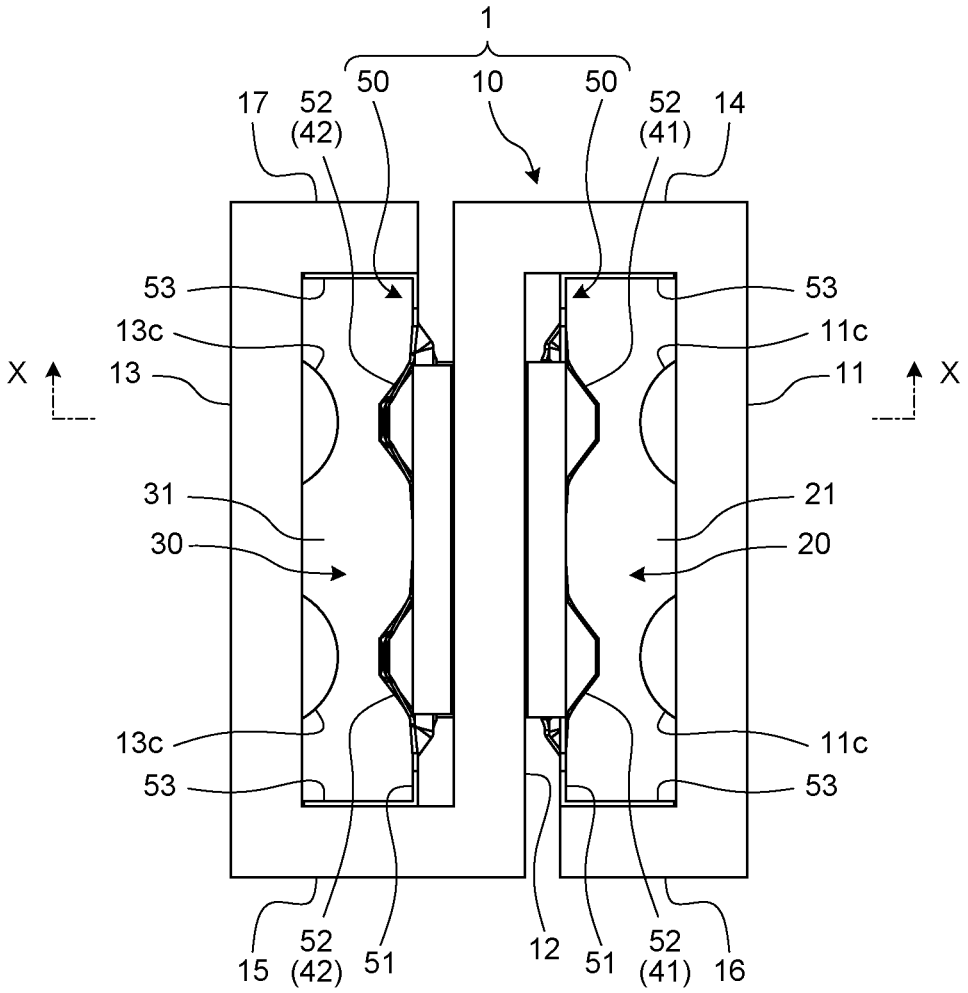
FIG. 3 is a plan view of the relay terminal in the embodiment that is seen from the one side of the opening.
Figure 4:
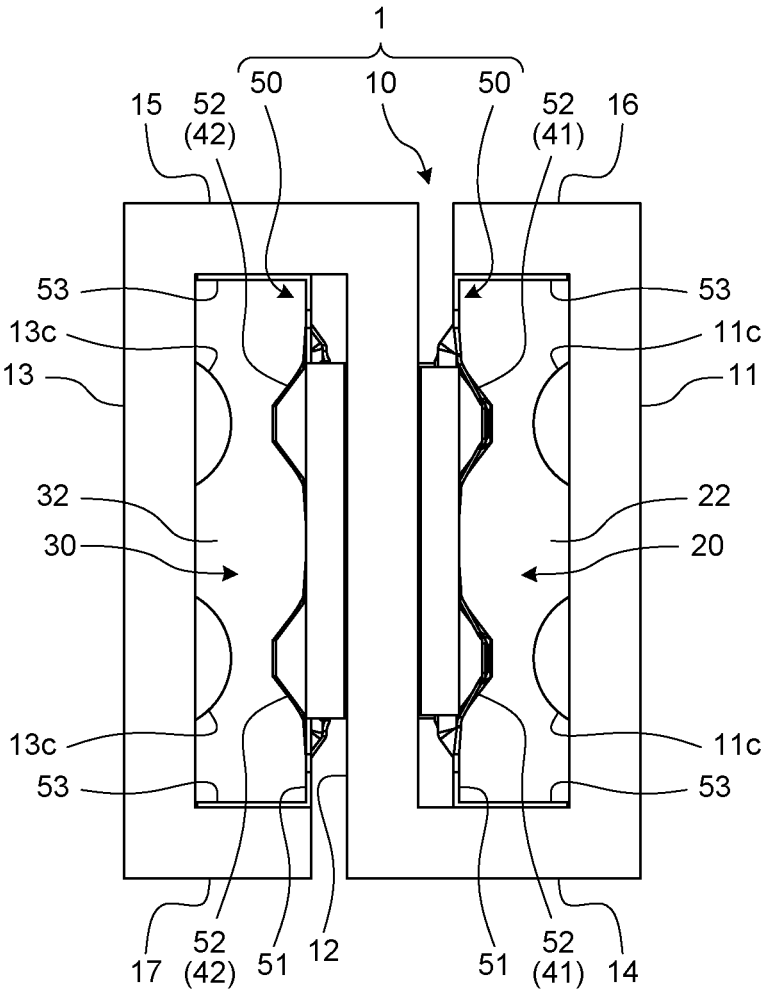
FIG. 4 is a plan view of the relay terminal in the embodiment that is seen from the other side of the opening.
Figure 5:
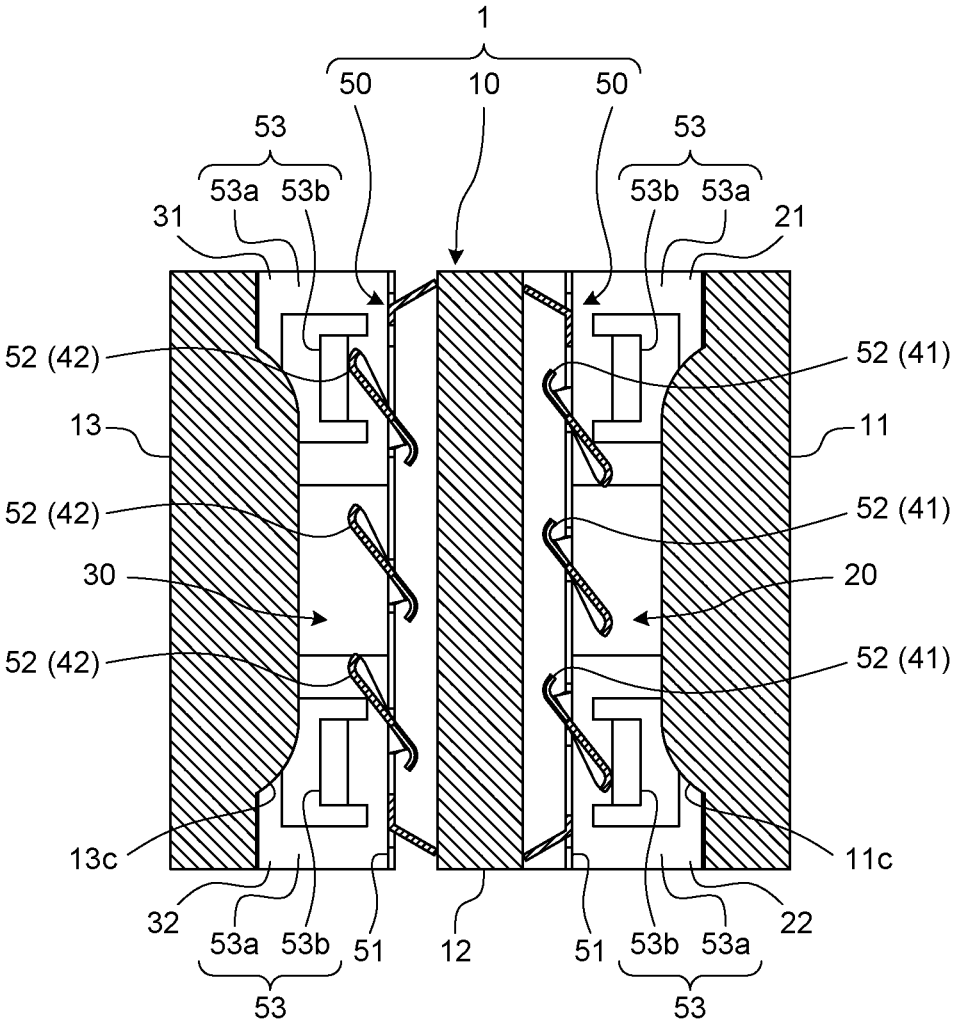
FIG. 5 is a cross-section view at a line X-X in FIG. 3.
Figure 6:
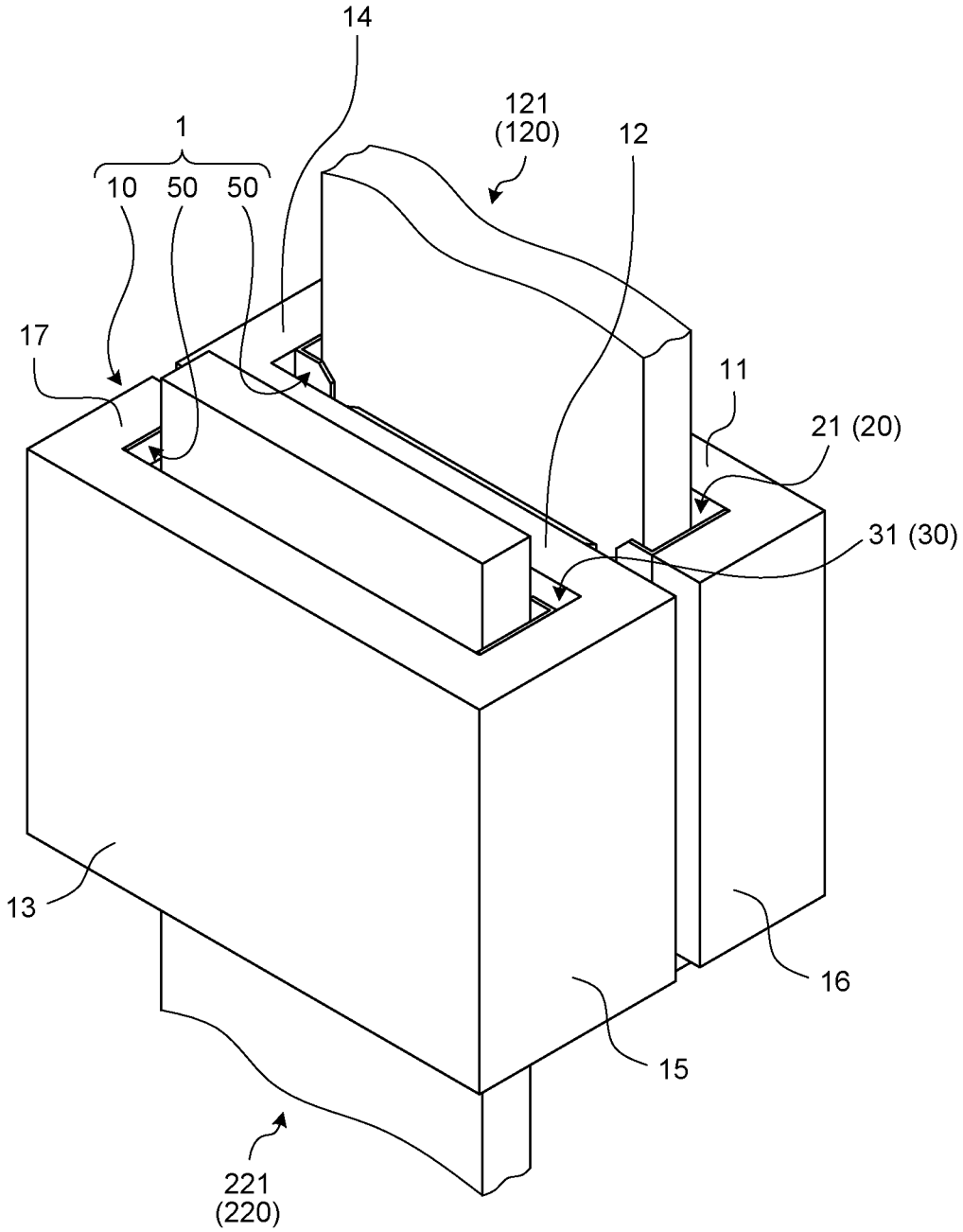
FIG. 6 is a perspective view illustrating the relay terminal to which first and second counterpart terminals are connected.

Furthermore, the first terminal housing chamber 20 includes a first elastic contact part 41 to be physically and electrically connected with the electrical connection part 121 of the first counterpart terminal 120 (FIG. 3 to FIG. 5). The first elastic contact part 41 is a contact part that is formed to have elasticity. The first elastic contact part 41 contacts the electrical connection part 121 of the first counterpart terminal 120 housed in the first terminal housing chamber 20, while imparting resilient force in a direction orthogonal to the insertion direction (insertion/extraction direction) of the first counterpart terminal 120. Thus, the relay terminal 1 can change a relative position of the first counterpart terminal 120 with respect to the first terminal housing chamber 20 in the resilient force imparting direction of the first elastic contact part 41, while ensuring the electrical connection state between the first terminal housing chamber 20 and the first counterpart terminal 120 through the first elastic contact part 41. Accordingly, the relay terminal 1 can absorb tolerance and variation between the first terminal housing chamber 20 and the first counterpart terminal 120 in the resilient force imparting direction.

The first elastic contact part 41 may be integrally formed on a wall surface of the first terminal housing chamber 20, or may be integrally formed with another part housed in the first terminal housing chamber 20.

Figure 7:
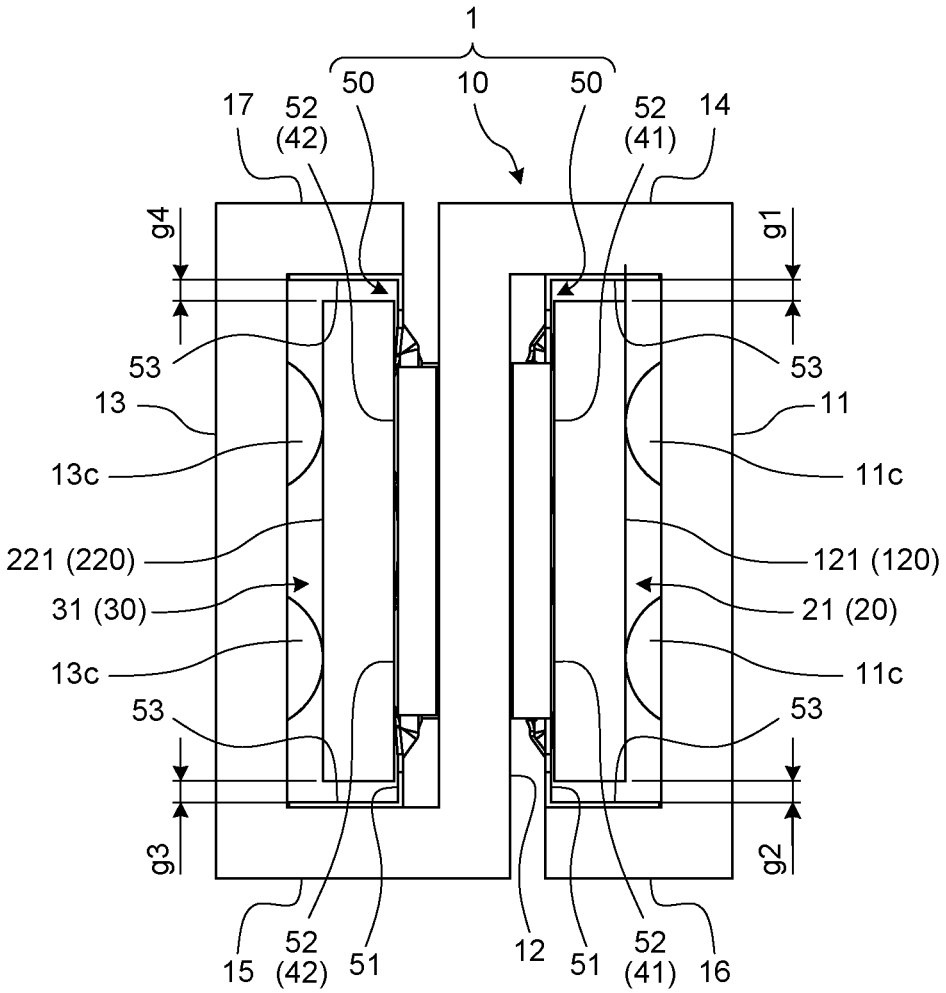
FIG. 7 is a plan view illustrating the relay terminal to which the first and the second counterpart terminals are connected.

Furthermore, the first terminal housing chamber 20 has gaps g1, g2 with respect to the electrical connection part 121 of the housed first counterpart terminal 120, in a direction (hereinafter, the "gap direction") orthogonal to the insertion direction (insertion/extraction direction) of the first counterpart terminal 120 and the resilient force imparting direction of the first elastic contact part 41 (FIG. 7). For example, in the first terminal housing chamber 20, the first elastic contact part 41 is arranged so as to contact the electrical connection part 121 of the first counterpart terminal 120 while imparting resilient force thereto, even when the electrical connection part 121 moves relatively to the first terminal housing chamber 20 by the gaps g1, g2 at a maximum. Thus, the relay terminal 1 can change a relative position of the first counterpart terminal 120 with respect to the first terminal housing chamber 20 in the gap direction, while ensuring the electrical connection state between the first terminal housing chamber 20 and the first counterpart terminal 120 through the first elastic contact part 41. Accordingly, the relay terminal 1 can absorb tolerance and variation between the first terminal housing chamber 20 and the first counterpart terminal 120 in the gap direction.

The second terminal housing chamber 30 is formed in a shape that conforms to the shape of an electrical connection part 221 of the second counterpart terminal 220 such that the electrical connection part 221 can be inserted and extracted. The second terminal housing chamber 30 does not necessarily have a shape equivalent to the first terminal housing chamber 20. However, the electrical connection part 221 of the exemplified second counterpart terminal 220 is formed in a rectangular plate shape (i.e., a male tab shape) similar to the electrical connection part 121 of the first counterpart terminal 120, as will be described later. Thus, the second terminal housing chamber 30 is formed to have a cuboid shape that is equivalent to the first terminal housing chamber 20. In the second terminal housing chamber 30, the electrical connection with the second counterpart terminal 220 is achieved by inserting and housing the electrical connection part 221 along the insertion direction. In addition, in the second terminal housing chamber 30, the electrical connection with the second counterpart terminal 220 is released by extracting the housed electrical connection part 221 along the extraction direction. The insertion/extraction direction of the electrical connection part 221 of the second counterpart terminal 220 with respect to the second terminal housing chamber 30 will be collectively referred to as the "insertion/extraction direction" herein.

The second terminal housing chamber 30 has two openings 31, 32 that are opposingly arranged (FIG. 1 and FIG. 2). Furthermore, the second terminal housing chamber 30 serves either of the two openings 31, 32 as an insertion opening for the electrical connection part 221 of the second counterpart terminal 220. Thus, the second terminal housing chamber 30 can cause the electrical connection part 221 that is inserted from either of the two openings 31, 32 to project from the other opening. In other words, the electrical connection part 221 can be inserted through the second terminal housing chamber 30 through the two openings 31, 32, as in the case of the first terminal housing chamber 20. In this manner, the relay terminal 1 can change a relative position of the second counterpart terminal 220 with respect to the second terminal housing chamber 30 in the insertion/extraction direction (i.e., a housed position of the electrical connection part 221), while ensuring the electrical connection state between the second terminal housing chamber 30 and the second counterpart terminal 220. For example, by setting an interval of the two openings 31, 32 of the second terminal housing chamber 30 shorter than the length of the electrical connection part 221 in the insertion/extraction direction, the relay terminal 1 can ensure the electrical connection state between the second terminal housing chamber 30 and the second counterpart terminal 220 even when the housed position of the electrical connection part 221 in the insertion/extraction direction has changed. Accordingly, the relay terminal 1 can absorb tolerance and variation between the second terminal housing chamber 30 and the second counterpart terminal 220 in the insertion/extraction direction.

In this regard, in the relay terminal 1, the first terminal housing chamber 20 and the second terminal housing chamber 30 may be formed such that the insertion/extraction direction of the first counterpart terminal 120 and the insertion/extraction direction of the second counterpart terminal 220 are the same as each other, or may be formed such that the respective insertion/extraction directions are different from each other. Furthermore, the first terminal housing chamber 20 and the second terminal housing chamber 30 are formed such that, when the respective insertion/extraction directions are the same as each other, the insertion direction of the first counterpart terminal 120 and the insertion direction of the second counterpart terminal 220 are the same or opposite from each other. The exemplified first terminal housing chamber 20 and second terminal housing chamber 30 are formed such that the insertion direction of the first counterpart terminal 120 and the insertion direction of the second counterpart terminal 220 are opposite from each other. Thus, the exemplified second terminal housing chamber 30 serves the opening 32 as an insertion opening for the electrical connection part 221 of the second counterpart terminal 220.

Furthermore, the second terminal housing chamber 30 includes a second elastic contact part 42 to be physically and electrically connected with the electrical connection part 221 of the second counterpart terminal 220 (FIG. 3 to FIG. 5). The second elastic contact part 42 is a contact part that is formed to have elasticity, as in the case of the first elastic contact part 41. The second elastic contact part 42 may have a shape equivalent to the first elastic contact part 41, or may have a shape different from the first elastic contact part 41. The second elastic contact part 42 contacts the electrical connection part 221 of the second counterpart terminal 220 housed in the second terminal housing chamber 30, while imparting resilient force in a direction orthogonal to the insertion direction (insertion/extraction direction) of the second counterpart terminal 220. Thus, the relay terminal 1 can change a relative position of the second counterpart terminal 220 with respect to the second terminal housing chamber 30 in the resilient force imparting direction of the second elastic contact part 42, while ensuring the electrical connection state between the second terminal housing chamber 30 and the second counterpart terminal 220 through the second elastic contact part 42. Accordingly, the relay terminal 1 can absorb tolerance and variation between the second terminal housing chamber 30 and the second counterpart terminal 220 in the resilient force imparting direction.

The second elastic contact part 42 may be integrally formed on a wall surface of the second terminal housing chamber 30, or may be integrally formed with another part housed in the second terminal housing chamber 30.

Furthermore, the second terminal housing chamber 30 has gaps g3, g4 with respect to the electrical connection part 221 of the housed second counterpart terminal 220, in a direction (hereinafter, the "gap direction") orthogonal to the insertion direction (insertion/extraction direction) of the second counterpart terminal 220 and the resilient force imparting direction of the second elastic contact part 42 (FIG. 7). For example, in the second terminal housing chamber 30, as in the case of the first terminal housing chamber 20, the second elastic contact part 42 is arranged so as to contact the electrical connection part 221 while imparting resilient force thereto, even when the electrical connection part 221 of the second counterpart terminal 220 moves relatively to the second terminal housing chamber 30 by the gaps g3, g4 at a maximum. Thus, the relay terminal 1 can change a relative position of the second counterpart terminal 220 with respect to the second terminal housing chamber 30 in the gap direction, while ensuring the electrical connection state between the second terminal housing chamber 30 and the second counterpart terminal 220 through the second elastic contact part 42. Accordingly, the relay terminal 1 can absorb tolerance and variation between the second terminal housing chamber 30 and the second counterpart terminal 220 in the gap direction.

In this manner, in the relay terminal 1, the first terminal housing chamber 20 is formed such that the electrical connection part 121 of the first counterpart terminal 120 is relatively moved in each of three directions orthogonal to one another, and the second terminal housing chamber 30 is formed such that the electrical connection part 221 of the second counterpart terminal 220 is relatively moved in each of the three directions orthogonal to one another. In other words, the relay terminal 1 can absorb tolerance and variation between the first terminal housing chamber 20 and the first counterpart terminal 120 in each of the three directions orthogonal to one another, and can absorb tolerance and variation between the second terminal housing chamber 30 and the second counterpart terminal 220 in each of the three directions orthogonal to one another. Accordingly, the relay terminal 1 can provide a desired electrical connection state between the first terminal housing chamber 20 and the first counterpart terminal 120, and can provide a desired electrical connection state between the second terminal housing chamber 30 and the second counterpart terminal 220. Therefore, the electrical connection state between the first counterpart terminal 120 and the second counterpart terminal 220 can be improved.

Hereinafter, a specific example of the relay terminal 1 will be described.

The terminal body 10 of the relay terminal 1 has first to third electrical connection bodies 11 to 13 that are arranged in parallel with intervals from one another, and coupling bodies 14, 15 that integrate these first to third electrical connection bodies 11 to 13 (FIG. 1 to FIG. 7). The exemplified first to third electrical connection bodies 11 to 13 and the coupling bodies 14, 15 are each formed in rectangular flat plate shapes. In addition, the exemplified first to third electrical connection bodies 11 to 13 are each formed in equivalent shapes.

In the terminal body 10, the first electrical connection body 11 and the second electrical connection body 12 are opposingly arranged with an interval from each other, and one sides of the opposingly arranged first electrical connection body 11 and the second electrical connection body 12 are coupled with the coupling body 14 (FIG. 1 to FIG. 7). The first electrical connection body 11 and the second electrical connection body 12 are opposingly arranged by setting the rectangular flat surfaces to face each other. The coupling body 14 is set orthogonal to each of the first electrical connection body 11 and the second electrical connection body 12.

The first terminal housing chamber 20 is formed by utilizing a space between the first electrical connection body 11 and the second electrical connection body 12. In this regard, the terminal body 10 has a wall body 16 that is erected from the other side of the first electrical connection body 11 toward the other side of the second electrical connection body 12 (FIG. 1 to FIG. 7). The wall body 16 is formed in a rectangular flat plate shape, and is set orthogonal to the first electrical connection body 11. Thus, the wall body 16 is arranged so as to oppose the coupling body 14 with an interval. In this specific example, a cuboid-shaped space that is surrounded by the first electrical connection body 11, the second electrical connection body 12, the coupling body 14, and the wall body 16 is utilized as the first terminal housing chamber 20. In the first terminal housing chamber 20, the rectangular-shaped opening 21 is formed with one ends of each of the first electrical connection body 11, the second electrical connection body 12, the coupling body 14, and the wall body 16, whereas the rectangular-shaped opening 22 is formed with the other ends of each of the first electrical connection body 11, the second electrical connection body 12, the coupling body 14, and the wall body 16.

In the first terminal housing chamber 20, the gap between the first electrical connection body 11 and the second electrical connection body 12 is made larger than a plate thickness of the electrical connection part 121 of the first counterpart terminal 120. In addition, in the first terminal housing chamber 20, the coupling body 14 is arranged such that the gap g1 is formed between the coupling body 14 and the electrical connection part 121, and the wall body 16 is arranged such that the gap g2 is formed between the wall body 16 and the electrical connection part 121. Thus, there will be no problem if the wall body 16 contacts the other side of the second electrical connection body 12. However, if a gap is provided with respect to the other side, the gap should be formed narrower than the plate thickness of the electrical connection part 121.

In addition, in the terminal body 10, the second electrical connection body 12 and the third electrical connection body 13 are opposingly arranged with an interval from each other, and the other sides of the opposingly arranged second electrical connection body 12 and the third electrical connection body 13 are coupled with the coupling body 15 (FIG. 1 to FIG. 7). The second electrical connection body 12 and the third electrical connection body 13 are opposingly arranged by setting the rectangular flat surfaces to face each other. The coupling body 15 is set orthogonal to each of the second electrical connection body 12 and the third electrical connection body 13.

The second terminal housing chamber 30 is formed by utilizing a space between the second electrical connection body 12 and the third electrical connection body 13. In this regard, the terminal body 10 has a wall body 17 that is erected from one side of the third electrical connection body 13 toward one side of the second electrical connection body 12 (FIG. 1 to FIG. 7). The wall body 17 is formed in a rectangular flat plate shape, and is set orthogonal to the third electrical connection body 13. Thus, the wall body 17 is arranged so as to oppose the coupling body 15 with an interval. In this specific example, a cuboid-shaped space that is surrounded by the second electrical connection body 12, the third electrical connection body 13, the coupling body 15, and the wall body 17 is utilized as the second terminal housing chamber 30. In the second terminal housing chamber 30, the rectangular-shaped opening 31 is formed with one ends of each of the second electrical connection body 12, the third electrical connection body 13, the coupling body 15, and the wall body 17, whereas the rectangular-shaped opening 32 is formed with the other ends of each of the second electrical connection body 12, the third electrical connection body 13, the coupling body 15, and the wall body 17.

In the second terminal housing chamber 30, the gap between the second electrical connection body 12 and the third electrical connection body 13 is made larger than a plate thickness of the electrical connection part 221 of the second counterpart terminal 220. In addition, in the second terminal housing chamber 30, the coupling body 15 is arranged such that the gap g3 is formed between the coupling body 15 and the electrical connection part 221, and the wall body 17 is arranged such that the gap g4 is formed between the wall body 17 and the electrical connection part 221. Thus, there will be no problem if the wall body 17 contacts one side of the second electrical connection body 12. However, if a gap is provided with respect to the one side, the gap should be formed narrower than the plate thickness of the electrical connection part 221.

The outer shape of the terminal body 10 in this specific example is formed in a cuboid shape by, for example, using a metal plate as a base material, and performing press molding in an S-shape. The terminal body 10 may have any shape, as long as it has the first to the third electrical connection bodies 11 to 13, the wall body 16, a wall body that is arranged so as to oppose the wall body 16 with an interval (e.g., coupling body 14), the wall body 17, and a wall body that is arranged so as to oppose the wall body 17 with an interval (e.g., coupling body 15). For example, the terminal body 10 may have the first to the third electrical connection bodies 11 to 13, the wall body 16, the coupling body 15, and a wall body that connects one sides of the first electrical connection body 11 and the third electrical connection body 13 at the positions of the coupling body 14 and the wall body 17.

As previously described, the first elastic contact part 41 may be integrally formed on the wall surface of the first terminal housing chamber 20, or may be integrally formed with another part housed in the first terminal housing chamber 20. In addition, the second elastic contact part 42 may be integrally formed on the wall surface of the second terminal housing chamber 30, or may be integrally formed with another part housed in the second terminal housing chamber 30.

When the first elastic contact part 41 is integrally formed on the wall surface of the first terminal housing chamber 20, at least one first elastic contact part 41 is formed in at least either of the first electrical connection body 11 and the second electrical connection body 12. For example, the first elastic contact part 41 is formed in a shape having elasticity by being bent with press molding to project from at least either of the first electrical connection body 11 and the second electrical connection body 12 toward the first terminal housing chamber 20. In addition, when the second elastic contact part 42 is integrally formed on the wall surface of the second terminal housing chamber 30, at least one second elastic contact part 42 is formed in at least either of the second electrical connection body 12 and the third electrical connection body 13. For example, the second elastic contact part 42 is formed in a shape having elasticity by being bent with press molding to project from at least either of the second electrical connection body 12 and the third electrical connection body 13 toward the second terminal housing chamber 30.

In this specific example, the first elastic contact part 41 and the second elastic contact part 42 are provided as separate parts. The relay terminal 1 in this case includes a first contact member that is assembled in the first terminal housing chamber 20, and a second contact member that is assembled in the second terminal housing chamber 30. The first contact member has the first elastic contact part 41. The second contact member has the second elastic contact part 42. In this regard, in the relay terminal 1 of this specific example, the first contact member and the second contact member are intended to be used in common, and a contact member 50 to be utilized as the first contact member and the second contact member is provided (FIG. 1 to FIG. 5).

Figure 8:
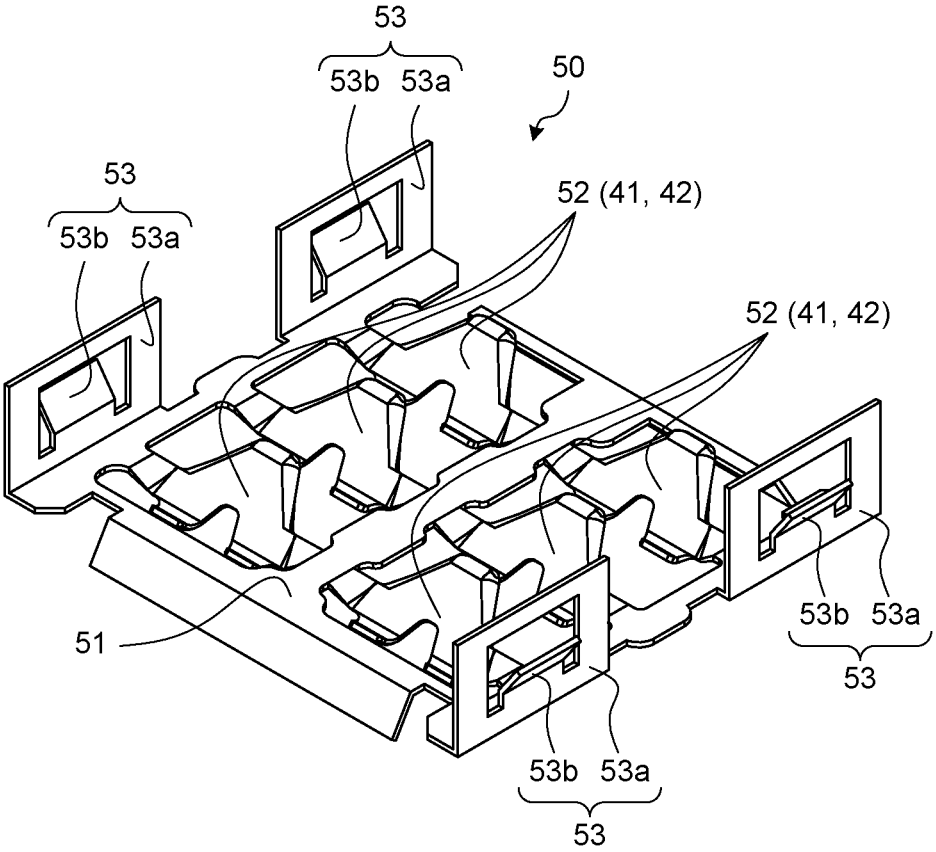
FIG. 8 is a perspective view illustrating a contact member.

The contact member 50 is formed with, for example, press molding by using a metal plate as a base material, and is housed and fixed in each of the first terminal housing chamber 20 and the second terminal housing chamber 30. The contact member 50 has a main body 51 having a rectangular shape, a plurality of elastic contact parts 52 that are bent to project in the same direction from the main body 51 with press molding, and a plurality of fitting and fixing parts 53 that each project in the same direction as the elastic contact parts 52 from two sides that are opposingly arranged in the main body 51 (FIG. 1 to FIG. 5, FIG. 7, and FIG. 8). The elastic contact parts 52 are portions to be utilized as the first elastic contact part 41 and the second elastic contact part 42, and are formed in shapes having elasticity by such bending. Six elastic contact parts 52 are formed in the main body 51. Each of the fitting and fixing parts 53 has a seat 53*a* that is formed in a rectangular shape, and an elastic piece part 53*b* that is bent to project to the opposite side of the elastic contact part 52 from the seat 53*a* with press molding (FIG. 5 and FIG. 8).

The contact member 50 is housed in the first terminal housing chamber 20 such that the elastic contact parts 52 project from the second electrical connection body 12 side to the first electrical connection body 11 side. Furthermore, the contact member 50 is housed in the first terminal housing chamber 20 such that resilient force acts on the coupling body 14 by the elastic piece part 53*b* on one side of the main body 51, and resilient force acts on the wall body 16 by the elastic piece part 53*b* on the other side of the main body 51. In this manner, the contact member 50 is fitted and fixed between the coupling body 14 and the wall body 16 in the state that the elastic contact parts 52 are arranged so as to oppose the first electrical connection body 11 with an interval. The contact member 50 is physically and electrically connected to the wall surface of the first terminal housing chamber 20 through at least the elastic piece part 53*b*.

In this regard, a plurality of indents (projecting parts) 11*c* that project toward the second electrical connection body 12 side, are formed in the exemplified first electrical connection body 11 (FIG. 3 to FIG. 5, and FIG. 7). In this example, two indents 11*c* that are extended in the insertion/extraction direction of the first counterpart terminal 120 are arranged with an interval, between the coupling body 14 and the wall body 16. The indents 11*c* are each arranged so as to oppose the elastic contact parts 52.

In the relay terminal 1, the shapes and the arrangements of each of the elastic contact parts 52 and the indents 11*c* are set such that a minimum gap between the elastic contact parts 52 and the indents 11*c* in the first terminal housing chamber 20 is narrower than the plate thickness of the electrical connection part 121 of the first counterpart terminal 120. In addition, in the relay terminal 1, the gap g1 is formed between the fitting and fixing part 53 on the coupling body 14 side and the electrical connection part 121, and the gap g2 is formed between the fitting and fixing part 53 on the wall body 16 side and the electrical connection part 121.

In addition, the contact member 50 is housed in the second terminal housing chamber 30 such that the elastic contact parts 52 project from the second electrical connection body 12 side to the third electrical connection body 13 side. Furthermore, the contact member 50 is housed in the second terminal housing chamber 30 such that resilient force acts on the coupling body 15 by the elastic piece part 53*b* on one side of the main body 51, and resilient force acts on the wall body 17 by the elastic piece part 53*b* on the other side of the main body 51. In this manner, the contact member 50 is fitted and fixed between the coupling body 15 and the wall body 17 in the state that the elastic contact parts 52 are arranged so as to oppose the third electrical connection body 13 with an interval. The contact member 50 is physically and electrically connected with the wall surface of the second terminal housing chamber 30 through at least the elastic piece part 53*b*.

In this regard, as in the case of the first electrical connection body 11, a plurality of indents (projecting parts) 13*c* that project to the second electrical connection body 12 side are formed in the exemplified third electrical connection body 13 (FIG. 3 to FIG. 5 and FIG. 7). In this example, as in the case of the first electrical connection body 11, two indents 13*c* that are extended in the insertion/extraction direction of the second counterpart terminal 220 are arranged with an interval, between the coupling body 15 and the wall body 17. The indents 13*c* are each arranged so as to oppose the elastic contact parts 52.

In the relay terminal 1, the shapes and the arrangements of each of the elastic contact parts 52 and the indents 13*c* are set such that a minimum gap between the elastic contact parts 52 and the indents 13*c* in the second terminal housing chamber 30 is narrower than the plate thickness of the electrical connection part 221 of the second counterpart terminal 220. In addition, in the relay terminal 1, the gap g3 is formed between the fitting and fixing part 53 on the coupling body 15 side and the electrical connection part 221, and the gap g4 is formed between the fitting and fixing part 53 on the wall body 17 side and the electrical connection part 221.

By forming the relay terminal 1 in this manner, in the relay terminal 1, the electrical connection part 121 of the first counterpart terminal 120 can be moved relatively to the first terminal housing chamber 20 in each of the three directions orthogonal to one another, and the electrical connection part 221 of the second counterpart terminal 220 can be moved relatively to the second terminal housing chamber 30 in each of the three directions orthogonal to one another. In this manner, the relay terminal 1 can absorb tolerance and variation between the first terminal housing chamber 20 and the first counterpart terminal 120 in each of the three directions orthogonal to one another, and can absorb tolerance and variation between the second terminal housing chamber 30 and the second counterpart terminal 220 in each of the three directions orthogonal to one another. Accordingly, the relay terminal 1 can provide a desired electrical connection state between the first terminal housing chamber 20 and the first counterpart terminal 120 through the first elastic contact parts 41 (elastic contact parts 52) and the indents 11*c*, and can provide a desired electrical connection state between the second terminal housing chamber 30 and the second counterpart terminal 220 through the second elastic contact parts 42 (elastic contact parts 52) and the indents 13*c*. Thus, the electrical connection state between the first counterpart terminal 120 and the second counterpart terminal 220 can be improved.

The relay terminal 1 described above forms a relay connector 70 by being housed in an insulating housing 60 (FIG. 9 to FIG. 12). The relay connector 70 includes at least one relay terminal 1. Hereinafter, an example of the relay connector 70 will be described.

The exemplified relay connector 70 includes a plurality of the relay terminals 1. In this example, six relay terminals 1 are included. The housing 60 has a terminal holding chamber 61 in which the relay terminals 1 are housed and held (FIG. 9 to FIG. 12). The housing 60 has the terminal holding chamber 61 for each of the relay terminals 1.

The terminal holding chamber 61 has an insertion opening 62 (FIG. 9, FIG. 11, and FIG. 12) for the first counterpart terminal 120, and an insertion opening 63 (FIG. 10) for the second counterpart terminal 220. The insertion opening 62 for the first counterpart terminal 120 is arranged so as to oppose the insertion opening (opening 21) for the first counterpart terminal 120 in the first terminal housing chamber 20 of the relay terminal 1. In addition, the insertion opening 63 for the second counterpart terminal 220 is arranged so as to oppose the insertion opening (opening 32) for the second counterpart terminal 220 in the second terminal housing chamber 30 of the relay terminal 1.

The exemplified terminal holding chamber 61 has an opening 64 (FIG. 9, FIG. 11, and FIG. 12) that is arranged so as to oppose the openings 21, 31 of the terminal body 10, and an opening 65 (FIG. 10) that is arranged so as to oppose the openings 22, 32 of the terminal body 10. The terminal holding chamber 61 utilizes at least either of the openings 64, 65 as the insertion openings 62, 63 in accordance with the insertion direction of the first counterpart terminal 120 and the insertion direction of the second counterpart terminal 220. As previously described, in this exemplification, the insertion direction of the first counterpart terminal 120 and the insertion direction of the second counterpart terminal 220 are opposite from each other. Thus, in this example, a portion of the opening 64 is utilized as the insertion opening 62, and a portion of the opening 65 is utilized as the insertion opening 63.

Figure 11:
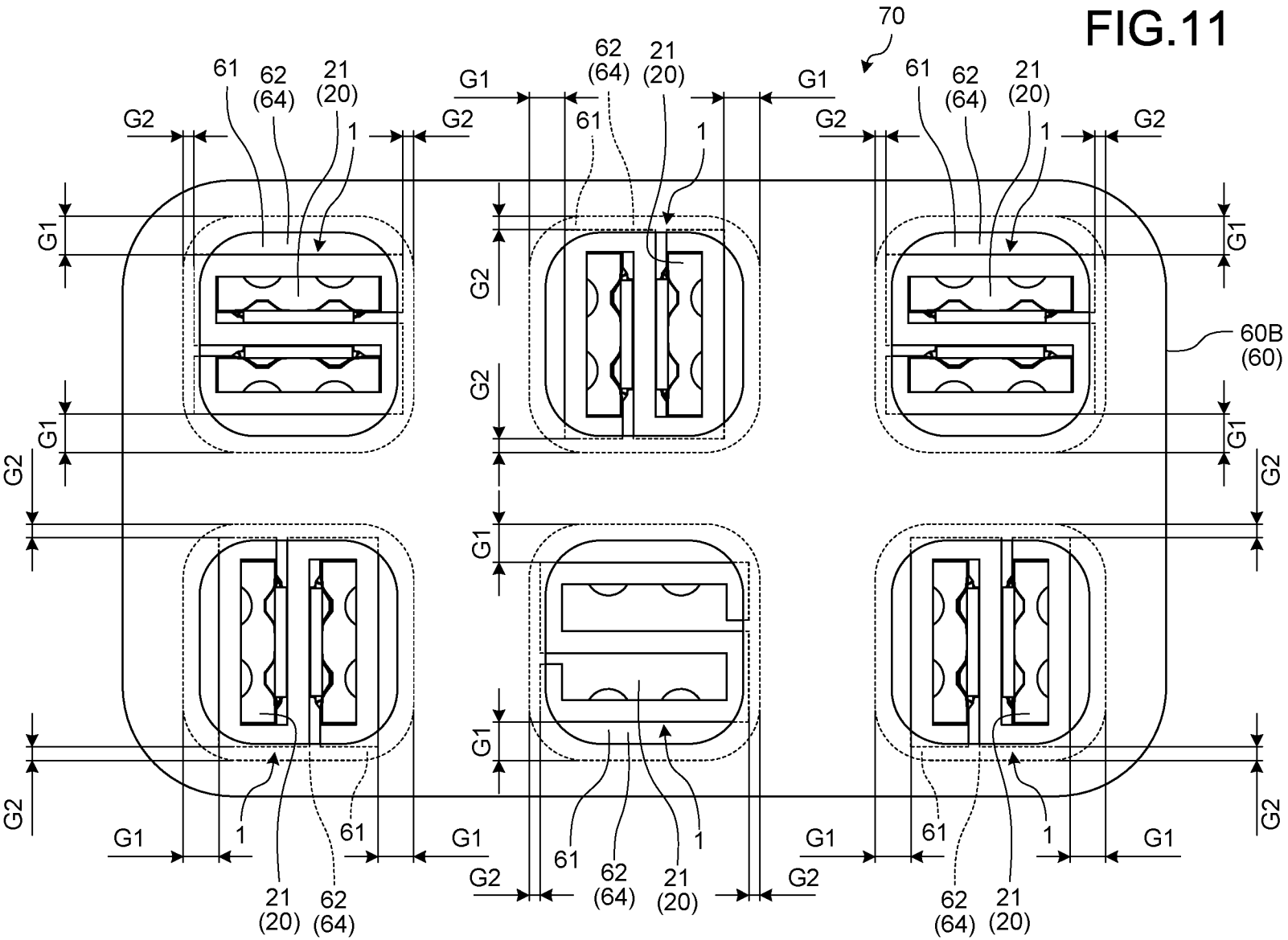
FIG. 11 is a plan view of the relay connector in the embodiment that is seen from the one side of the opening.

Furthermore, the terminal holding chamber 61 has a first gap G1 that is configured to relatively move the relay terminal 1 housed in the terminal holding chamber 61 in the resilient force imparting direction of the first elastic contact parts 41 (elastic contact parts 52), and a second gap G2 that is configured to relatively move the relay terminal 1 housed in the terminal holding chamber 61 in a direction orthogonal to the insertion direction (insertion/extraction direction) of the first counterpart terminal 120 and the resilient force imparting direction of the first elastic contact parts 41 (elastic contact parts 52) (FIG. 11). In this exemplification, since the relay terminal 1 is located at approximately the center of the terminal holding chamber 61, the first gap G1 and the second gap G2 are each provided at two positions. In this manner, in the terminal holding chamber 61, the relay terminal 1 can be moved relatively to the terminal holding chamber 61, in both directions orthogonal to the insertion/extraction direction of the first and the second counterpart terminals 120, 220. The openings 64, 65 are made smaller than the relay terminal 1 in consideration of the relative movement, such that the relay terminal 1 can be continuously held in the terminal holding chamber 61.

Figure 9:
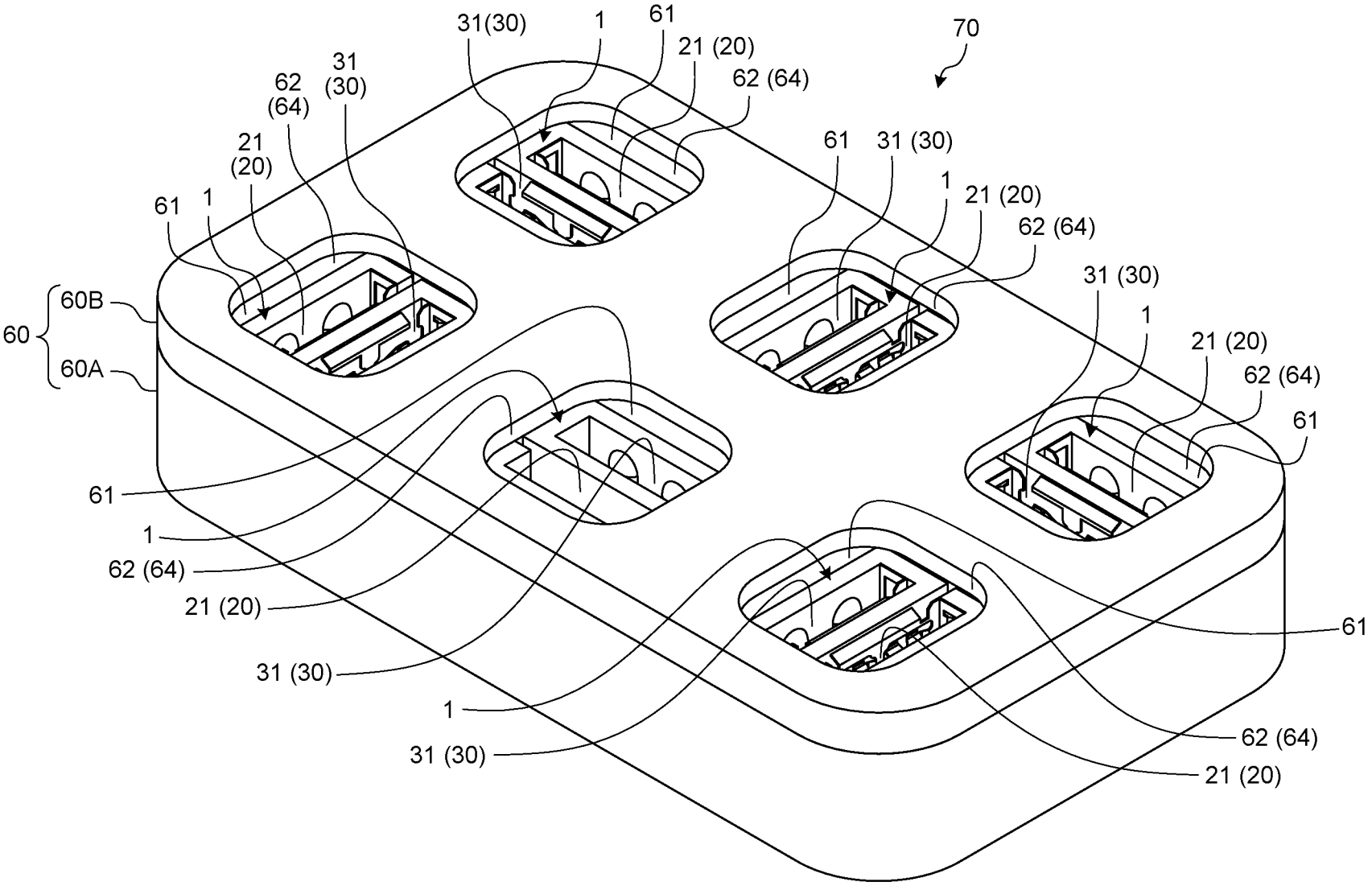
FIG. 9 is a perspective view illustrating a relay connector in the embodiment.
Figure 10:
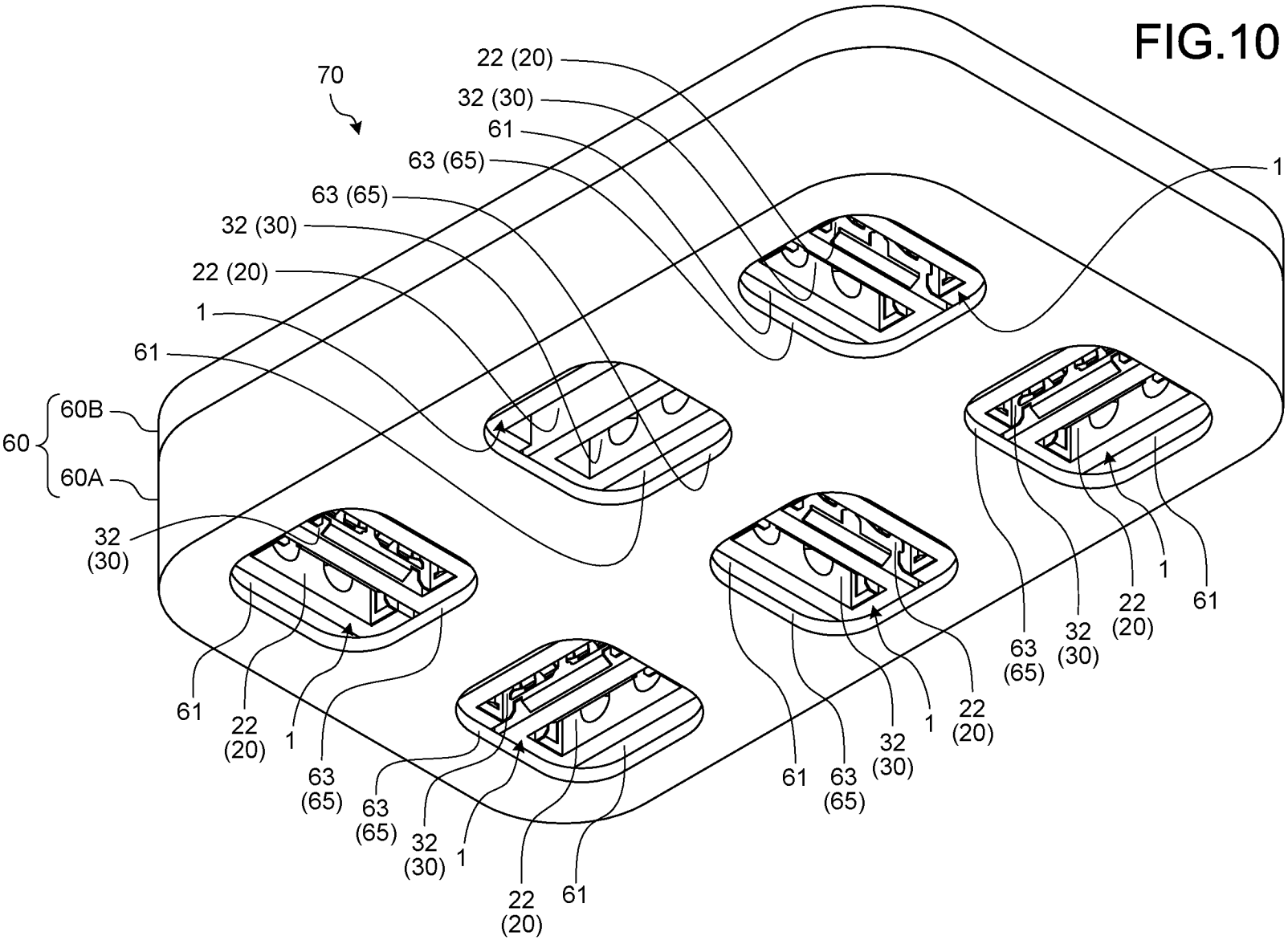
FIG. 10 is a perspective view of the relay connector in the embodiment that is seen from another angle.
Figure 12:
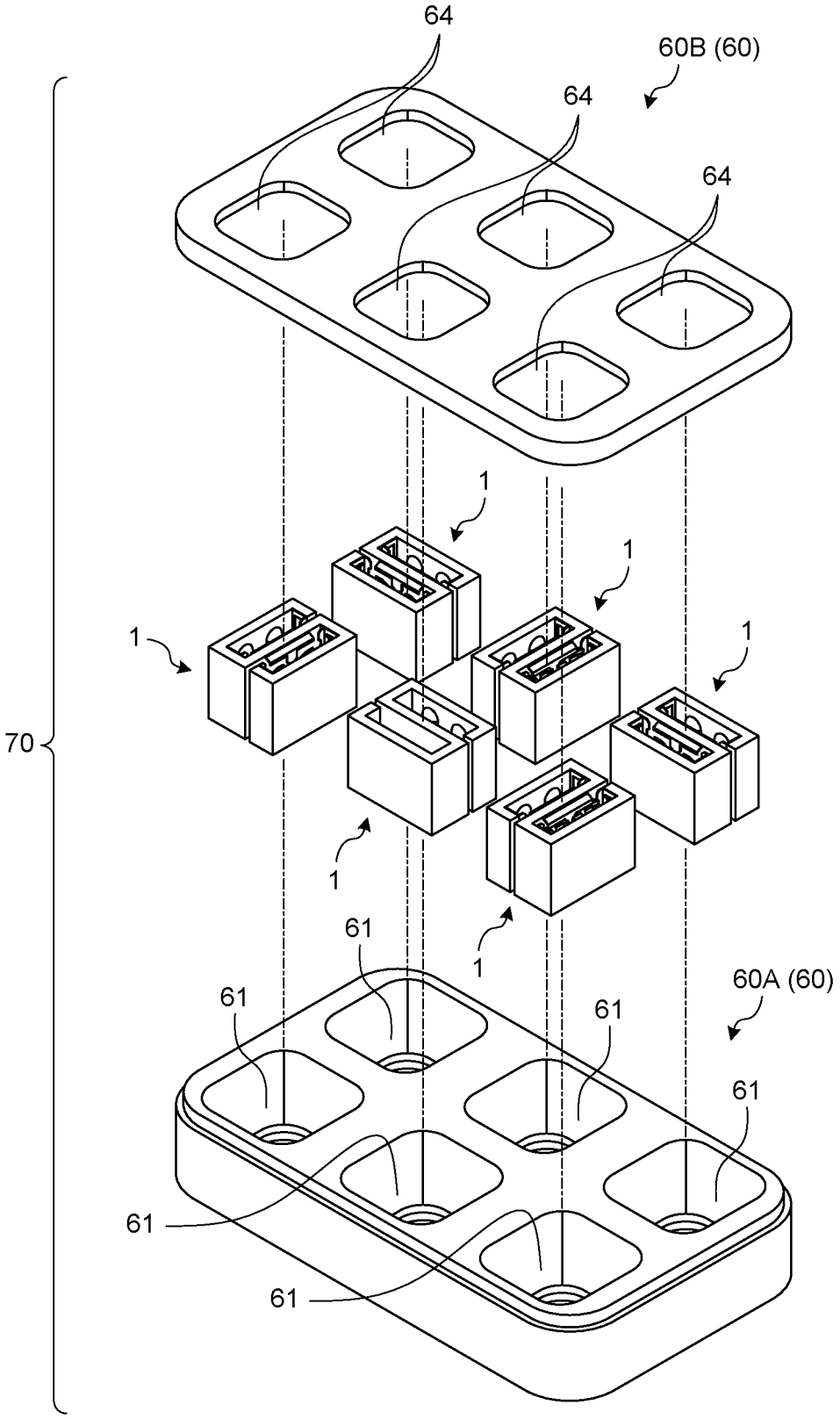
FIG. 12 is an exploded perspective view of the relay connector in the embodiment.

Specifically, the exemplified housing 60 includes a housing member 60A and a lid member 60B (FIG. 9, FIG. 10, and FIG. 12). The housing 60 forms the terminal holding chamber 61 with the housing member 60A and the lid member 60B. The housing member 60A and the lid member 60B are made of insulating materials such as synthetic resins. A main space for the terminal holding chamber 61 and the opening 65 (insertion opening 63) are formed in the housing member 60A. The opening 64 (insertion opening 62) is formed in the lid member 60B. The lid member 60B closes the periphery of the opening of the main space for the terminal holding chamber 61 while leaving the opening 64 (insertion opening 62), by being fit on the housing member 60A in which the relay terminals 1 are housed.

By forming the relay connector 70 in this manner, in the relay connector 70, each of the relay terminals 1 can be moved relatively to the terminal holding chamber 61 in both directions orthogonal to the insertion/extraction direction of the first and the second counterpart terminals 120, 220. Furthermore, the relay connector 70 can move the electrical connection part 121 of the first counterpart terminal 120 relatively to the first terminal housing chamber 20 in each of the three directions orthogonal to one another, and can move the electrical connection part 221 of the second counterpart terminal 220 relatively to the second terminal housing chamber 30 in each of the three directions orthogonal to one another, for each of the relay terminals 1. In this manner, the relay connector 70 can absorb tolerance and variation between the first terminal housing chamber 20 and the first counterpart terminal 120 in each of the three directions orthogonal to one another, and can absorb tolerance and variation between the second terminal housing chamber 30 and the second counterpart terminal 220 in each of the three directions orthogonal to one another, for each of the relay terminals 1.

Furthermore, the relay connector 70 can absorb tolerance and variation among a plurality of the first counterpart terminals 120 in the three directions orthogonal to one another, and can absorb tolerance and variation among a plurality of the second counterpart terminals 220 in the three directions orthogonal to one another, due to the working effect of the relay terminal 1 alone combined with the relative movement of the relay terminal 1. Accordingly, the relay connector 70 can provide a desired electrical connection state between the first terminal housing chamber 20 and the first counterpart terminal 120 through the first elastic contact parts 41 (elastic contact parts 52) and the indents 11*c*, and can provide a desired electrical connection state between the second terminal housing chamber 30 and the second counterpart terminal 220 through the second elastic contact parts 42 (elastic contact parts 52) and the indents 13*c*, for each of the relay terminals 1. Thus, the relay connector 70 can improve the electrical connection state between the first counterpart terminal 120 and the second counterpart terminal 220 in all the relay terminals 1. Furthermore, in the relay connector 70, a pair of the first counterpart terminal 120 and the second counterpart terminal 220 is connected to each relay terminal 1 by being arranged in a direction orthogonal to the insertion/extraction direction. Thus, the body size in the insertion/extraction direction can be made small.

Figure 13:
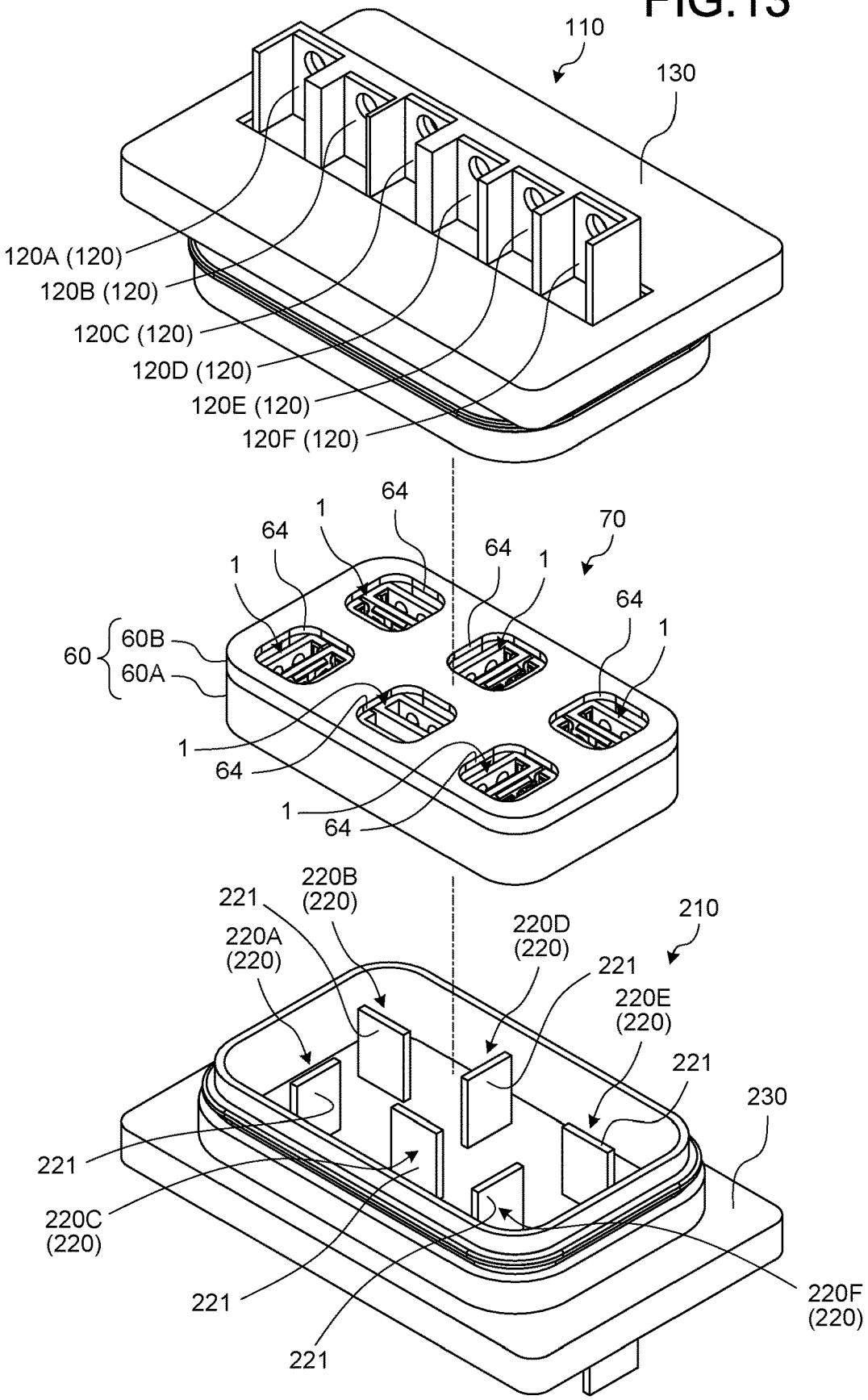
FIG. 13 is a perspective view illustrating the relay connector before connection of the first and the second counterpart terminals.
Figure 14:
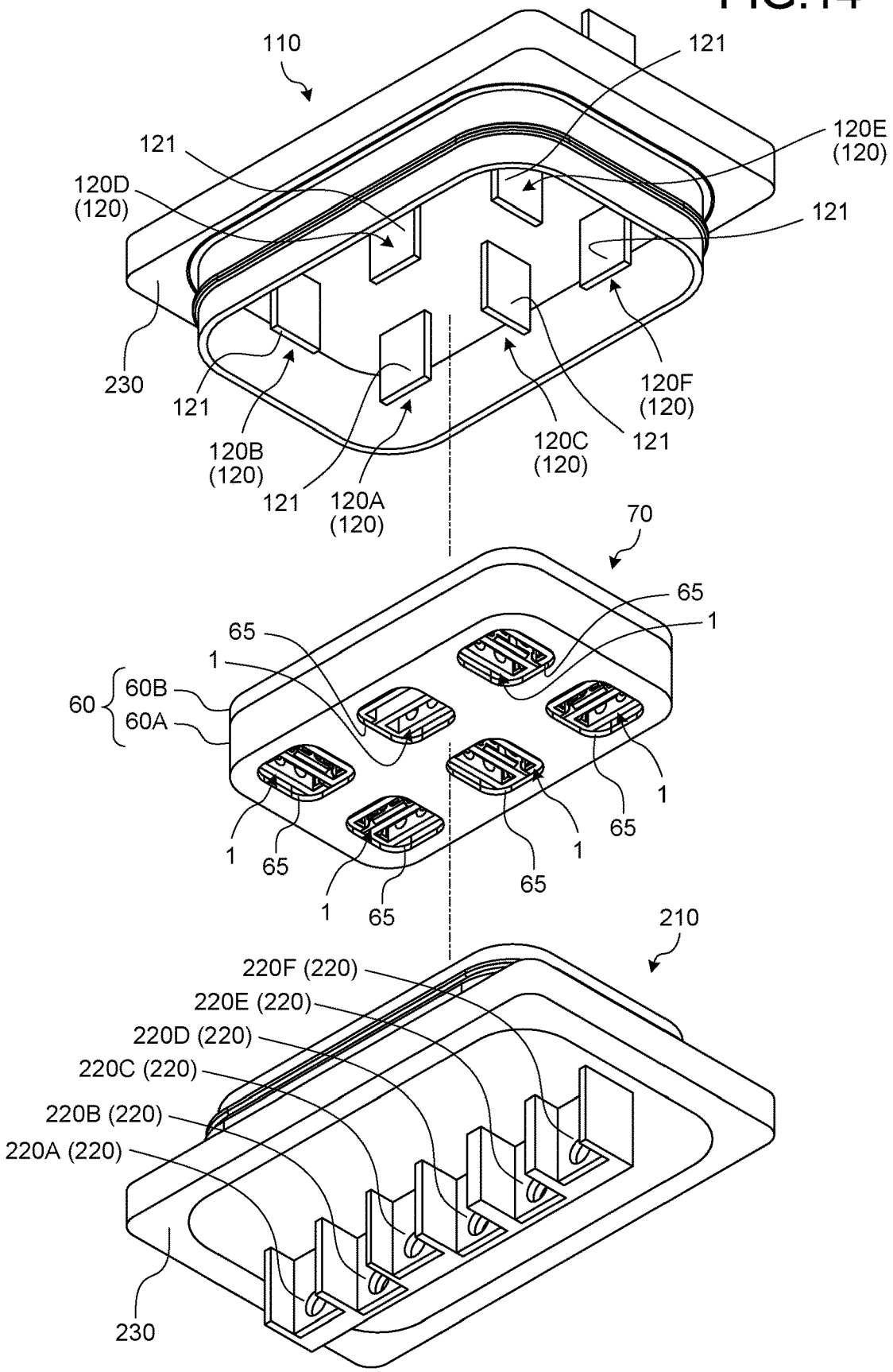
FIG. 14 is a perspective view of the relay connector before connection of the first and the second counterpart terminals that is seen from another angle.
Figure 15:
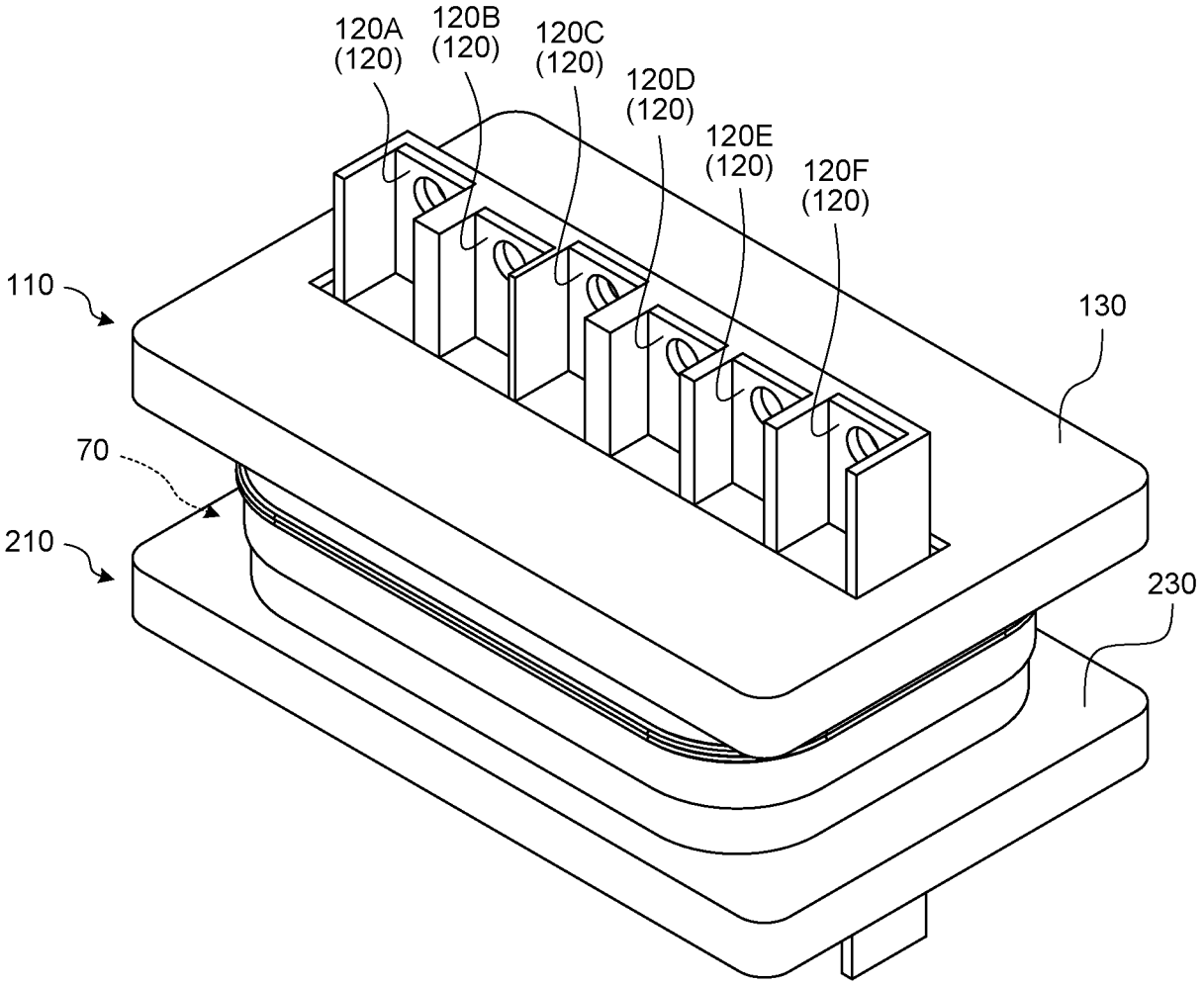
FIG. 15 is a perspective view illustrating the relay connector after connection of the first and the second counterpart terminals.

For example, the relay connector 70 is used for electrically connecting an inverter and a rotating machine, in a vehicle using a rotating machine as driving force such as an electric automobile or hybrid vehicle. The inverter (not illustrated) is provided with a first mating connector 110 that includes the first counterpart terminal 120 (FIG. 13 to FIG. 15). The rotating machine (not illustrated) is provided with a second mating connector 210 that includes the second counterpart terminal 220 (FIG. 13 to FIG. 15). By physically and electrically connecting the relay connector 70 to each of the first mating connector 110 and the second mating connector 210, the first mating connector 110 and the second mating connector 210 are electrically connected.

The exemplified first mating connector 110 includes six first counterpart terminals 120 (first counterpart terminals 120A to 120F) (FIG. 14). The first counterpart terminals 120A to 120F are each housed in an insulating housing 130 in the state that the electrical connection parts 121 project in the same direction. In addition, the exemplified second mating connector 210 includes six second counterpart terminals 220 (second counterpart terminals 220A to 220F) (FIG. 13). The second counterpart terminals 220A to 220F are each housed in an insulating housing 230 in the state that the electrical connection parts 221 project in the same direction.

In this exemplification, by causing the inverter and the rotating machine to approach each other, the first mating connector 110 and the second mating connector 210 sandwich the relay connector 70, and the pair of the first counterpart terminal 120 and the second counterpart terminal 220 is connected to each of the relay terminals 1.

Figure 16:
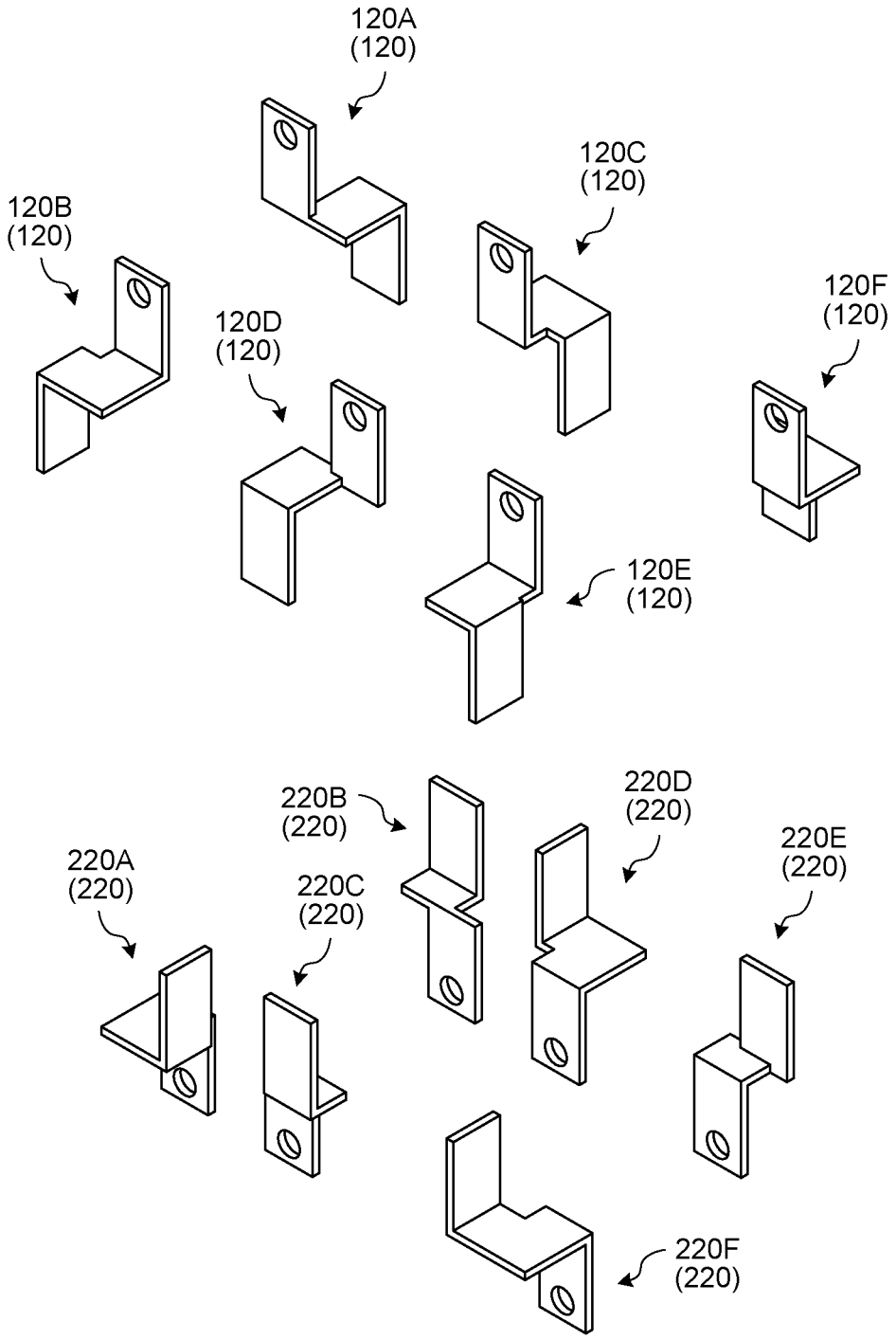
FIG. 16 is a perspective view illustrating the first and the second counterpart terminals.

In this regard, by adjusting the housed state of each of the six relay terminals 1 in the terminal holding chamber 61 such as by shifting each of them by 90 degrees, at least two of the first counterpart terminals 120A to 120F and the second counterpart terminals 220A to 220F can be used in common. In this exemplification, the same things are used for the first counterpart terminals 120B, 120C, and the second counterpart terminals 220A, 220D (FIG. 16).

In the relay terminal and the relay connector according to the present embodiments, the first terminal housing chamber is formed such that the first counterpart terminal is relatively moved in each of the three directions orthogonal to one another, and the second terminal housing chamber is formed such that the second counterpart terminal is relatively moved in each of the three directions orthogonal to one another. In other words, the relay terminal and the relay connector can absorb tolerance and variation between the first terminal housing chamber and the first counterpart terminal in each of the three directions orthogonal to one another, and can absorb tolerance and variation between the second terminal housing chamber and the second counterpart terminal in each of the three directions that are orthogonal to one another. Accordingly, the relay terminal and the relay connector can provide a desired electrical connection state between the first terminal housing chamber and the first counterpart terminal, and can provide a desired electrical connection state between the second terminal housing chamber and the second counterpart terminal. Therefore, the electrical connection state between the first counterpart terminal and the second counterpart terminal can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A relay terminal, comprising:

a terminal body being made of a conductive material and including a first terminal housing chamber into which a first counterpart terminal is inserted and housed, and a second terminal housing chamber into which a second counterpart terminal is inserted and housed, wherein the first terminal housing chamber serves either of two openings that are opposingly arranged as an insertion opening for the first counterpart terminal, and includes a first elastic contact part that contacts the first counterpart terminal housed in the first terminal housing chamber while imparting resilient force in a direction orthogonal to an insertion direction of the first counterpart terminal, and a gap with respect to the first counterpart terminal housed in the first terminal housing chamber in a direction orthogonal to the insertion direction of the first counterpart terminal and the resilient force imparting direction of the first elastic contact part, the second terminal housing chamber serves either of two openings that are opposingly arranged as an insertion opening for the second counterpart terminal, and includes a second elastic contact part that contacts the second counterpart terminal housed in the second terminal housing chamber while imparting resilient force in a direction orthogonal to an insertion direction of the second counterpart terminal, and a gap with respect to the second counterpart terminal housed in the second terminal housing chamber in a direction orthogonal to the insertion direction of the second counterpart terminal and the resilient force imparting direction of the second elastic contact part, and the first elastic contact part and the second elastic contact part are electrically connected via the terminal body.

2. The relay terminal according to claim 1, wherein the first terminal housing chamber and the second terminal housing chamber are formed such that the insertion direction of the first counterpart terminal and the insertion direction of the second counterpart terminal are the same or are opposite from each other.

3. The relay terminal according to claim 1, wherein the terminal body includes first to third electrical connection bodies that are arranged in parallel with intervals from one another, and a coupling body that integrates the first to the third electrical connection bodies, the first terminal housing chamber is formed by utilizing a space between the first electrical connection body and the second electrical connection body that are opposingly arranged with an interval from each other, and the second terminal housing chamber is formed by utilizing a space between the second electrical connection body and the third electrical connection body that are opposingly arranged with an interval from each other.

4. The relay terminal according to claim 2, wherein the terminal body includes first to third electrical connection bodies that are arranged in parallel with intervals from one another, and a coupling body that integrates the first to the third electrical connection bodies, the first terminal housing chamber is formed by utilizing a space between the first electrical connection body and the second electrical connection body that are opposingly arranged with an interval from each other, and the second terminal housing chamber is formed by utilizing a space between the second electrical connection body and the third electrical connection body that are opposingly arranged with an interval from each other.

5. The relay terminal according to claim 3, wherein the first elastic contact part is formed in at least either of the first electrical connection body and the second electrical connection body, and the second elastic contact part is formed in at least either of the second electrical connection body and the third electrical connection body.

6. The relay terminal according to claim 4, wherein the first elastic contact part is formed in at least either of the first electrical connection body and the second electrical connection body, and the second elastic contact part is formed in at least either of the second electrical connection body and the third electrical connection body.

7. The relay terminal according to claim 1, further comprising:

a first contact member assembled in the first terminal housing chamber, and a second contact member assembled in the second terminal housing chamber, wherein the first contact member has the first elastic contact part, and the second contact member has the second elastic contact part.

8. The relay terminal according to claim 2, further comprising:

a first contact member assembled in the first terminal housing chamber, and a second contact member assembled in the second terminal housing chamber, wherein the first contact member has the first elastic contact part, and the second contact member has the second elastic contact part.

9. The relay terminal according to claim 3, further comprising:

a first contact member assembled in the first terminal housing chamber, and a second contact member assembled in the second terminal housing chamber, wherein the first contact member has the first elastic contact part, and the second contact member has the second elastic contact part.

10. The relay terminal according to claim 4, further comprising:

a first contact member assembled in the first terminal housing chamber, and a second contact member assembled in the second terminal housing chamber, wherein the first contact member has the first elastic contact part, and the second contact member has the second elastic contact part.

11. A relay connector, comprising:

a relay terminal; and a housing including a terminal holding chamber in which the relay terminal is housed and held, wherein the relay terminal includes a terminal body being made of a conductive material and including a first terminal housing chamber into which a first counterpart terminal is inserted and housed, and a second terminal housing chamber into which a second counterpart terminal is inserted and housed, the first terminal housing chamber serves either of two openings that are opposingly arranged as an insertion opening for the first counterpart terminal, and includes a first elastic contact part that contacts the first counterpart terminal housed in the first terminal housing chamber while imparting resilient force to a direction orthogonal to an insertion direction of the first counterpart terminal, and a gap with respect to the first counterpart terminal housed in the first terminal housing chamber in a direction orthogonal to the insertion direction of the first counterpart terminal and the resilient force imparting direction of the first elastic contact part, the second terminal housing chamber serves either of two openings that are opposingly arranged as an insertion opening for the second counterpart terminal, and includes a second elastic contact part that contacts the second counterpart terminal housed in the second terminal housing chamber while imparting resilient force in a direction orthogonal to an insertion direction of the second counterpart terminal, and a gap with respect to the second counterpart terminal housed in the second terminal housing chamber in a direction orthogonal to the insertion direction of the second counterpart terminal and the resilient force imparting direction of the second elastic contact part, the first terminal housing chamber and the second terminal housing chamber are formed such that the insertion direction of the first counterpart terminal and the insertion direction of the second counterpart terminal are the same or are different from each other, the terminal holding chamber has an insertion opening for the first counterpart terminal that is arranged so as to oppose the insertion opening for the first counterpart terminal in the first terminal housing chamber, an insertion opening for the second counterpart terminal that is arranged so as to oppose the insertion opening for the second counterpart terminal in the second terminal housing chamber, a first gap that is configured to relatively move the relay terminal housed in the terminal holding chamber in the resilient force imparting direction of the first elastic contact part, and a second gap that is configured to relatively move the relay terminal housed in the terminal holding chamber in a direction orthogonal to the insertion direction of the first counterpart terminal and the resilient force imparting direction of the first elastic contact part, and the first elastic contact part and the second elastic contact part are electrically connected via the terminal body.

* * * * *